United States Patent [19]

McConaughy et al.

[11] 4,399,872

[45] Aug. 23, 1983

[54] GUIDELINELESS SYSTEM FOR RISER ENTRY/REENTRY THAT PERMITS QUICK RELEASE OF A RISER COLUMN FROM A SUBSEA INSTALLATION

[75] Inventors: Robert C. McConaughy, Walnut Creek, Calif.; Joe W. Wright, Lafayette, La.

[73] Assignee: Chevron Research Company, San Francisco, Calif.

[21] Appl. No.: 340,144

[22] Filed: Jan. 18, 1982

Related U.S. Application Data

[63] Continuation of Ser. No. 132,571, Mar. 21, 1980, abandoned.

[51] Int. Cl.[3] ..... E21B 7/128

[52] U.S. Cl. ..... 166/341

[58] Field of Search ..... 166/341, 338, 343, 342, 166/362; 285/93 X

[56] References Cited

U.S. PATENT DOCUMENTS

| | | | |
|---|---|---|---|
| 3,534,984 | 10/1970 | Shney | 285/93 X |
| 3,602,301 | 8/1971 | James | 166/338 |
| 4,031,544 | 6/1977 | Lapertinn | 166/341 X |
| 4,080,025 | 3/1978 | Garnier et al. | 166/343 X |
| 4,167,215 | 9/1979 | Thorne | 166/341 |

*Primary Examiner*—William F. Pate, III

*Attorney, Agent, or Firm*—D. A. Newell; E. J. Keeling

[57] ABSTRACT

A guidelineless riser entry/reentry system which permits a safe and quick release of a riser column from a subsea installation. The system includes two guide funnels mounted on opposite sides of the subsea installation at the upper end thereof for the purpose of engaging respective telescopic posts mounted at the lower end of the riser column. With the posts in an extended position, the riser may be appropriately maneuvered to position the posts in their respective guide funnels. In this way, the riser is properly positioned on and orientated with respect to the subsea installation. The riser may then be disconnectably connected to the subsea installation and the posts moved into a retracted position so that the riser may be rapidly removed from the subsea installation.

20 Claims, 9 Drawing Figures

GUIDELINELESS SYSTEM FOR RISER ENTRY/REENTRY THAT PERMITS QUICK RELEASE OF A RISER COLUMN FROM A SUBSEA INSTALLATION

This is a continuation of application Ser. No. 132,571 filed Mar. 21, 1980, abandoned.

FIELD OF THE INVENTION

The present invention relates to subsea drilling operations, and more particularly, to a guidelineless system for riser entry and reentry at a subsea well site.

BACKGROUND OF THE INVENTION

The production of oil and gas at offshore sites has increased dramatically in recent years. The drilling of wells at these sites is normally conducted from floating drilling vessels, such as semi-submersibles or drill ships, through a riser that extends from the vessel to a subsea installation at the site. A riser entry/reentry system is used to make the connection between the vessel and the subsea installation. During drilling, the vessel is maintained in position above the subsea installation by means of either a static or dynamic positioning system.

One of the problems that can occur, however, with the dynamic positioning system is that of "drift-off". That is, power to the vessel's positioning thrusters or control of the thrusters is lost, causing the vessel to drift off location. Another but similar problem is "drive-off". Here, the vessel is forced off location because an incorrect control command is sent to the vessel's thrusters. In both situations, obviously, the riser has to be disconnected from the subsea installation. Accordingly, the riser entry/reentry system, a guidelineless one being normally employed when operating from a dynamically positioned vessel, must permit quick release of the riser from the subsea installation. The system should also allow the riser to be reconnected to the subsea installation with very little loss of time and with very little difficulty.

In certain waters, icebergs also pose a hazard to drilling operations. For should the drilling site be in the path of an oncoming iceberg, drilling operations will have to be quickly terminated so that the vessel may move out of the way. Here again, and this applies whether the vessel is dynamically or statically positioned above the drilling site, there must be the capability to quickly disconnect the riser from the subsea installation. And when the vessel moves back on location, or moves on location for the first time, the riser entry/-reentry system should permit the riser to be connected to the subsea installation with a minimum of problems.

U.S. Pat. No. 4,167,215, issued Sept. 11, 1979, is a guidelineless system for entry and reentry into a subsea wellhead. This system employs a TV/sonar guidance means for locating the wellhead along with additional apparatus for properly positioning a riser and service equipment at the wellhead. The system has an offset funnel mounted on the wellhead to guide a probe, which is mounted at the lower end of the riser, into alignment with the wellhead. When the probe is located in the funnel's neck, it is locked therein so that proper alignment is maintained between the wellhead and the riser as well as the associated service equipment. With the probe locked into position in the funnel neck, well entry, tree installation, well reentry, tree cap removal and replacement, and downhole wireline operations may be completed without the use of guidelines. To perform repair and replacement work at the wellhead, the system further includes a component manipulator device which is used to maneuver equipment about the wellhead. The manipulator includes a pair of hydraulic lowering arms that are connected to a running tool; the hydraulic arms are also connected to the probe. The hydraulic arms are used to position the running tool and to lower the probe into the offset funnel.

The above-discussed system, however, is an overly complex arrangement for a riser entry/reentry system that is designed simply to permit quick release of the riser from the subsea installation and quick reconnection thereto. Moreover, since the probe of this system is locked into the neck of the offset funnel, it does not actually provide a quick release capability. This is due to the fact that before the riser could be disconnected from the subsea installation, the probe would have to be unlocked and withdrawn from the funnel. And in high angle release situations that occur during vessel "drive-off" or "drift-off", the probe would hang up in the funnel, delaying removal of the riser from the subsea installation and causing damage to the riser and subsea installation.

The present invention is thus directed to a rather simple guidelineless riser entry/reentry system that permits a safe and quick release of the riser from the subsea installation. The system also provides an efficient means for riser entry and reentry. And the system can also be used to convert a substantial guideline system into a guidelineless one while still retaining the features of the guideline system.

SUMMARY OF THE INVENTION

Broadly speaking, the present invention is for a guidelineless system for entry and reentry of a riser column at an underwater well location. The system permits rapid removal of the riser column from the subsea installation as well as quick and efficient entry and reentry of the riser column to the subsea installation.

The system of the present invention includes two telescoping posts affixed one each on opposite sides of the riser column at the lower end thereof. Each of the posts are movable between an extended and a retracted position. When the riser column is being lowered to the subsea installation for connection thereto, the posts are in their extended position. This is so that each of the posts will enter a respective one of a pair of guide funnels affixed to the upper end of the subsea installation on opposite sides thereof.

By moving the riser column onto the subsea installation so that the posts are each located in a guide funnel, the riser column will be correctly positioned and orientated with respect to the subsea installation. Once the riser column is disconnectably connected to the subsea installation, the posts will be moved into their retracted position. This permits the posts to easily clear the funnels when it is necessary to remove the riser in quick release situations.

Means are also provided on the riser column to locate the subsea installation. It is also noted that the guide funnels may be removably mounted to the guide frame that is part of the subsea installation. Thus, by removing the guide funnels, the guidelineless system of the present invention may be converted to a guideline system which uses conventional guideposts and guidelines.

A particular object of the present invention is to provide a guidelineless riser entry/reentry system that permits a safe and quick release of the riser from the subsea installation. Additional objects and advantages of the invention will become apparent from a detailed reading of the specification and drawings which are incorporated herein and made part of the specification.

DESCRIPTION OF THE PREFERRED EMBODIMENT

Figure 1:
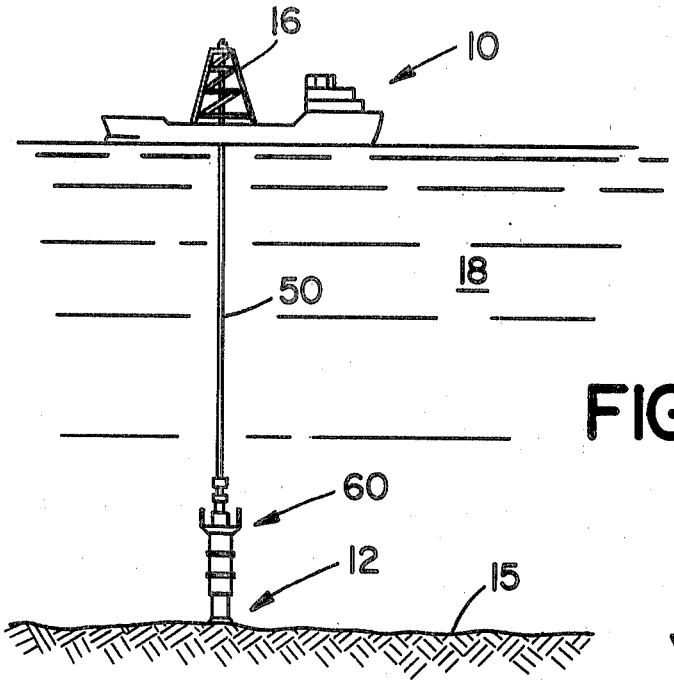
FIG. 1 is a schematic, elevational view illustrating a drilling vessel positioned above a subsea well site.

Referring to the drawings, and particularly to FIG. 1, there is illustrated an offshore drilling vessel 10 appropriately positioned in a body of water 18 above a subsea well site 12 in the underwater bottom 15. A drilling rig 16 is located on the deck of the vessel to run drill pipe and to handle cable and for the performance of other functions that are well known in the art. A marine riser or riser column 50 extends from the drilling vessel to the subsea well site where it is connected to a subsea installation 60, which, as will be discussed, includes a blowout-preventer (BOP) stack. The riser serves as a guide for the drill stem and as a conductor of drilling fluids. It consists of several sections of pipe. Special devices for tensioning the riser and for compensating for movement of the vessel relative to the riser are also provided.

At this point, it is noted that the present invention has so far been described with respect to offshore drilling operations. However, it should be understood that this invention is not limited to use in drilling operations. It may be used in production or any other type of offshore operations where such a riser entry/reentry system is desirable. And in this respect, the riser column may be a production riser or some other string of pipe extending between a vessel at the water's surface and a subsea installation.

Figure 2:
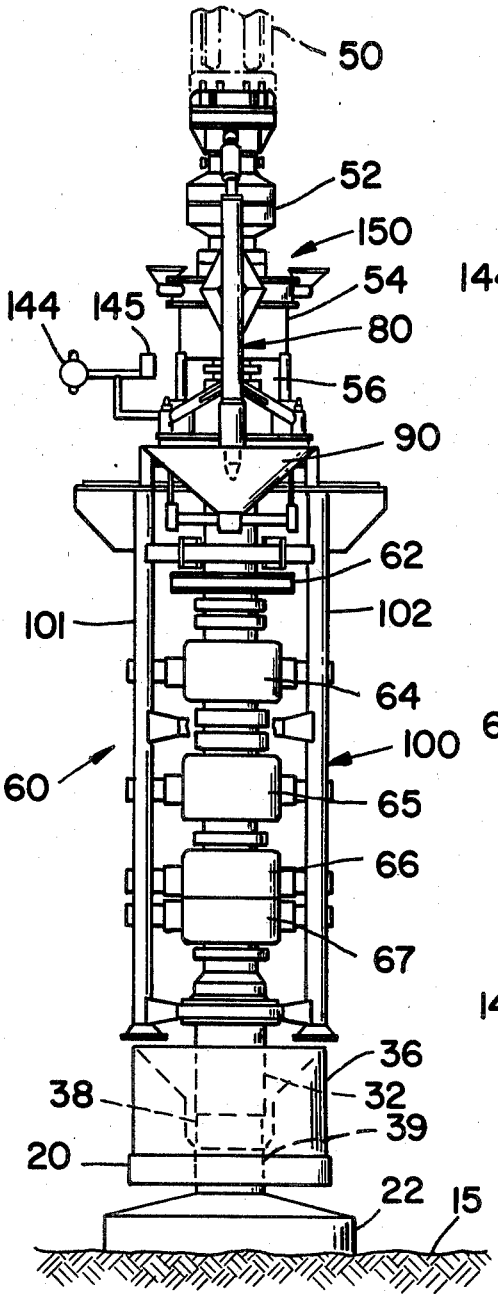
FIG. 2 is a schematic, elevational view, partly in section, illustrating the riser connected to a subsea blowout-preventer stack.

As is shown in FIG. 2, the subsea installation includes conventional guideline equipment, namely, a temporary guide base 22 on which a permanent guide base 20 without guideposts is positioned. The permanent guide base is supported by means of a foundation pile, not illustrated, in underwater bottom 15. A wellhead 39 extends through the permanent guide base and has a mandrel 38 affixed thereto. The BOP connector 32 connects the BOP stack to mandrel 38 and the funnel-shaped guide 36 serves to position the BOP stack on the wellhead. The BOP stack may contain any appropriate number and types of blowout-preventers that are necessary for controlling well pressures during drilling. As shown in FIG. 2, the BOP stack is made up of ram-type preventers 64, 65, 66, and 67, and an annular preventer 62.

Figure 8:
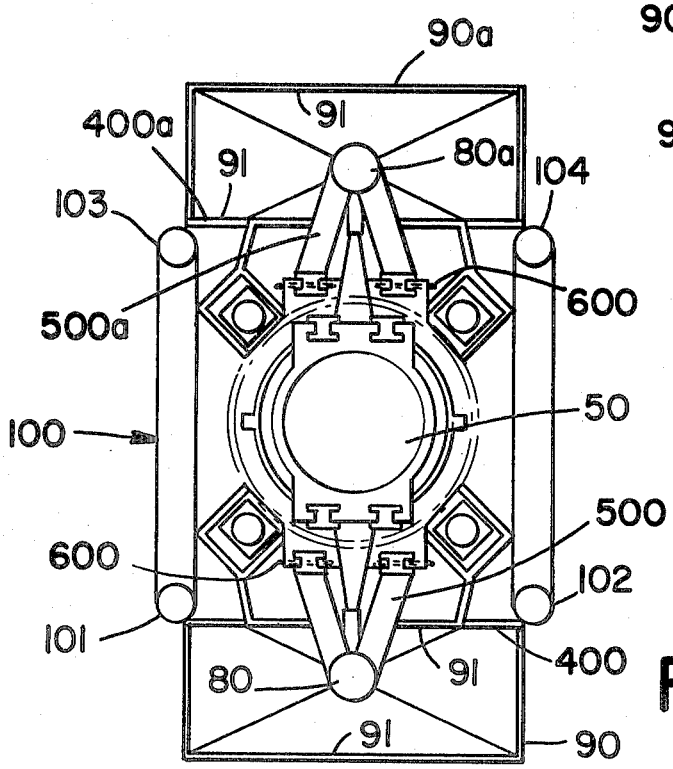
FIG. 8 is a plan view along line 8—8 of FIG. 2.

A guide frame, generally indicated by numeral 100, see FIGS. 2 and 8, is an integral part of the BOP stack and essentially comprises a plurality of tubular posts 101, 102, 103, and 104 that are structurally tied together by appropriate cross-members. The guide frame supports the stack when the stack is being positioned on the wellhead and provides protection for the stack after it is in position. It is understood that with the guidelineless system of the present invention, as is known in the art, the BOP stack is positioned on the wellhead by guidelineless means. But this guidelineless system may be converted to a guideline system by affixing guideposts to guide base 20 and extending guidelines from the posts to the vessel. Then to position the BOP stack on the wellhead, a guideline would be extended through each of the guide frame posts so that the guide frame may be lowered onto the guideposts to position the equipment at the subsea installation.

Figure 9:
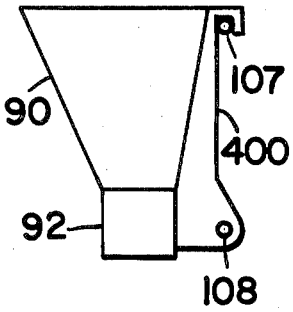
FIG. 9 is a schematic view illustrating the means for mounting the guide funnels to the subsea installation.

As noted heretofore, the riser entry/reentry system of the present invention is a guidelineless one. It includes guide funnels or guide cones 90 and 90*a*, see FIG. 8, connected at the upper end and on opposite sides of subsea installation 60. In particular, guide funnel 90 is connected to the guide frame between guide frame posts 101 and 102 in a manner which permits the guide funnel to be removed from the guide frame. As shown in FIG. 9, this may be done by simply providing a bracket 400 at the back of guide funnel 90 where the bracket is hooked onto the guide frame at member 107 and pinned thereto at point 108. In a like manner, guide funnel 90*a* is removably mounted between guide frame posts 103 and 104 by means of bracket 400*a*. The guide funnels may thus be disconnected and removed from the guide frame posts when it is desired to convert the guidelineless system of the invention to a guideline system.

Figure 5:
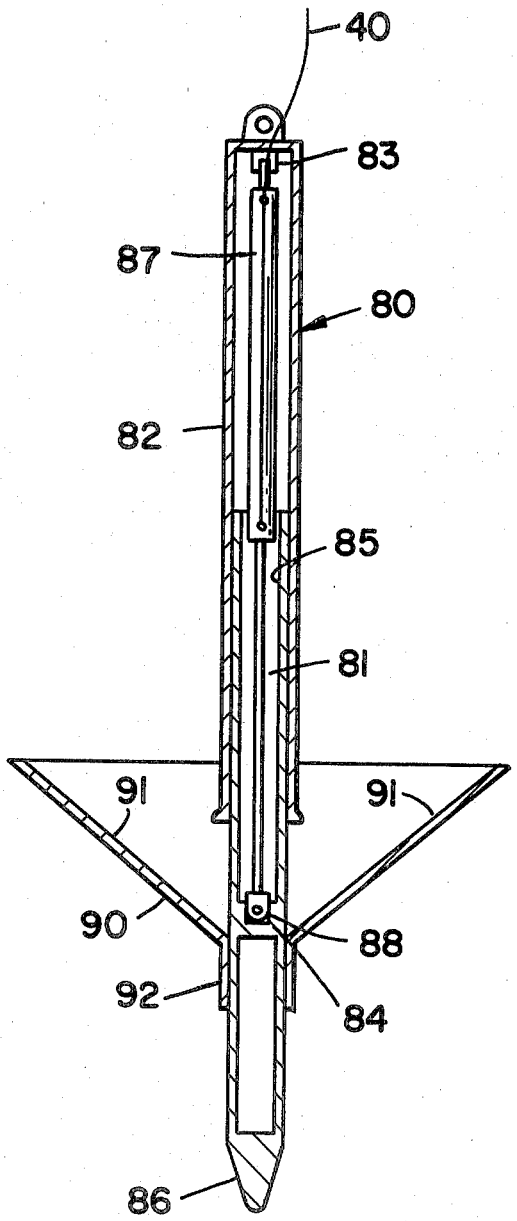
FIG. 5 is a schematic view, in section, illustrating the guidelineless system of the present invention in greater detail with a telescoping post shown in its extended position.

The guide funnels are positioned on opposite sides of the subsea installation to be diametrically opposed from each other. The larger opening or mouth portion of each guide funnel is positioned upwardly with respect to the subsea installation. The mouth portion is appropriately sized and shaped to capture the probes or telescopic posts, discussed below, despite sizable inclinations in the riser's movement due to ocean currents or overtravel or undertravel of the drilling vessel. As shown in FIGS. 5 and 8, the guide funnels may be rectangular in shape with the interior walls 91 of the respective funnels sloping towards a lower or neck portion 92 of each funnel. And neck portion 92 extends axially downwardly from the mouth portion and is sized so that the lower portion of the telescopic posts may pass therethrough for final alignment and orientation of the riser column relative to the subsea installation.

As shown in FIGS. 2 and 8, telescopic guideposts 80 and 80*a* are mounted at the lower end of riser column 50. In actual drilling operations, it may be expected that the telescopic posts are mounted on lower marine riser package 150 that is connected to the lower end of riser 50. The lower marine riser package essentially includes flex joint 52, which is connected to riser 50, annular blowout-preventer 54, and connector 56 for operatively connecting the riser to subsea installation 60. The telescopic guideposts are arranged on opposite sides of the riser column to be diametrically opposed from each other so that they may engage a respective guide funnel. This permits the riser to be correctly positioned on and orientated with respect to the subsea installation. And as with the guide funnels, the telescopic posts may be removably mounted at the lower end of the riser. This is done, see FIG. 8, by pinning, by means of pins 600, brackets 500 and 500*a*, which extend from posts 80 and 80*a*, respectively, to appropriate slots formed in the lower marine riser package.

Figure 3:
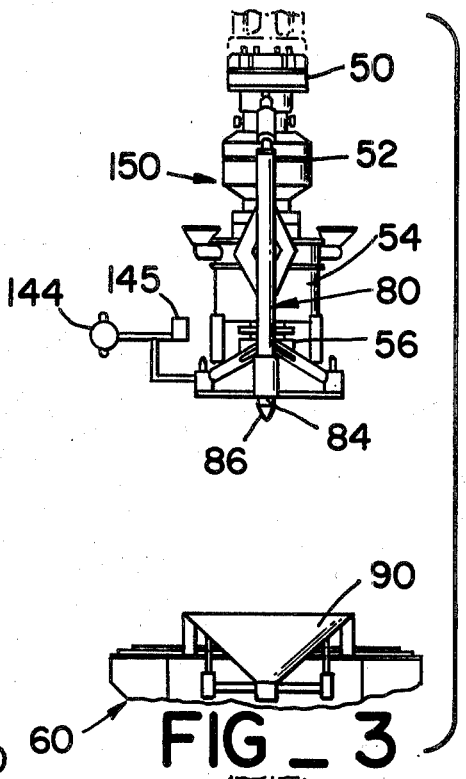
FIG. 3 is a schematic, elevational view illustrating the riser being removed from the subsea blowout-preventer stack.
Figure 4:
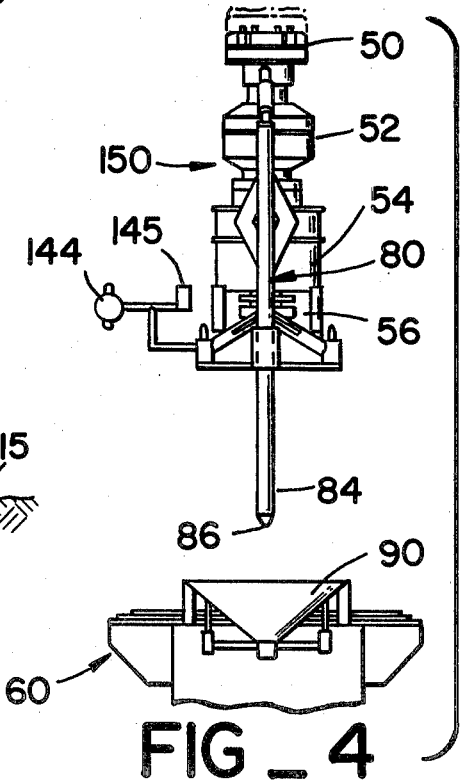
FIG. 4 is a schematic, elevational view illustrating the riser being lowered to and positioned on the subsea blowout-preventer stack.

The telescopic guideposts are illustrated in greater detail in FIG. 5 where post 80 is shown, it being understood that the details of post 80*a* are the same. Each telescopic guidepost comprises a substantial cylindrical-shaped housing 82 appropriately affixed and positioned on the lower marine riser package to be substantially parallel therewith. A probe arm 84 having a downwardly-tapered lower end 86 is concentrically arranged to be slidably movable within housing 82. The telescopic posts may be operated to move the arms 84 between a retracted position, see FIGS. 3 and 6, and an extended position, see FIGS. 4 and 5. In the extended position, the lower portion 86 of the probe arm extends substantially below riser connector 56 that is part of the lower marine riser package. In the retracted position, the probe arm is located substantially within housing 82 with just the lower, tapered portion 86 of the arm extending outside of housing 82.

Figure 6:
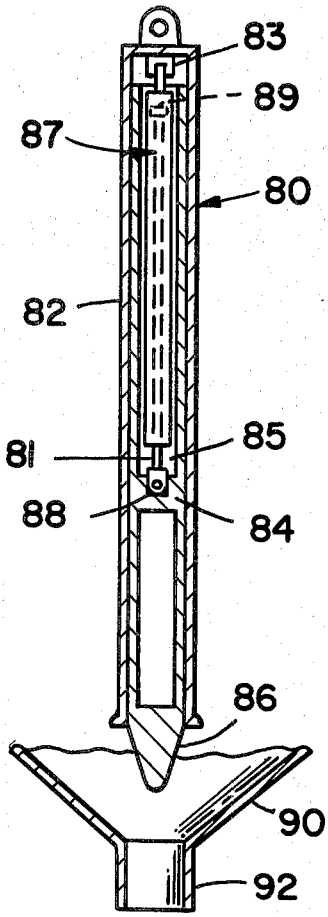
FIG. 6 is schematic, sectional view illustrating the guidelineless system of the present invention in greater detail with a telescoping post shown in its retracted position.

To move probe arm 84 between its extended and retracted position, a piston-cylinder assembly 87 is provided within housing 82, see FIGS. 5 and 6. The upper end of piston-cylinder assembly 87 is bolted or otherwise affixed to the top of housing 82 at point 83. Piston rod 81 of piston assembly 87 is connected between the probe arm 84 at point 88 and piston 89 of the piston-cylinder assembly. Power to operate telescopic post 80 is provided by a hydraulic line 40 that is connected between a hydraulic control unit, not illustrated, on vessel 10 and piston-cylinder 87 of post 80. Line 40 is also manifolded to the piston-cylinder assembly of post 80*a* so that the posts are operated simultaneously by the hydraulic control unit onboard the vessel.

As is well known in the art, piston-cylinder assembly 87 is operated by flowing hydraulic fluid through line 40 to one side or the other of piston 89 to move arm 84 within housing 82 between its extended and retracted positions. Appropriate fluid passageways in communication with line 40 are provided within cylinder 89 of the piston-cylinder assembly to flow and exhaust fluid from the assembly in response to the direction that the arm 84 is to be moved. It is noted that above point 88 on arm 84, an extended groove 85 is formed in the arm. The groove has dimensions that are somewhat greater than cylinder 89 so that the cylinder will not interfere with movement of the probe arm into its retracted position.

Figure 7:
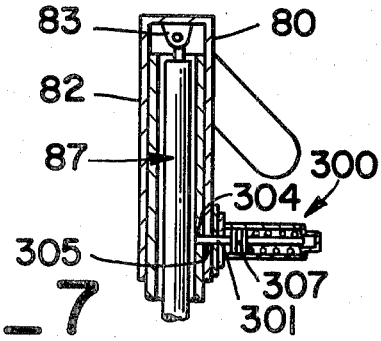
FIG. 7 is a schematic, sectional view illustrating an apparatus for holding the telescoping posts in their retracted position.

As illustrated in FIG. 7, a simple locking apparatus 300 may also be provided on each telescopic post to lock their arms into their retracted position. Locking apparatus 300 is mounted near the upper end of housing 82 where a spring-biased piston 307 and rod 301 are arranged to engage a groove 304 formed in the upper end of the probe arm. An opening 305 is formed in housing 82 so that groove 304 is aligned with opening 305 when arm 84 is in its retracted position. Thus, when the probe arm is powered into its retracted position, groove 304 is aligned with opening 305 to allow spring-biased rod 301 to move into opening 304. This will lock the probe arm into its retracted position. When the probe arm is to be moved to its extended position, locking assembly 300 will be operated by appropriate means to withdraw rod 301 from opening 304. For example, this may be done by providing an appropriate connection from hydraulic line 40 to locking assembly 300 so that rod 301 is hydraulically activated to be withdrawn from groove 304 when arm 84 is to be powered to its extended position.

To connect riser column 50 to the subsea installation, the vessel 10 is first positioned over the well site by means of a navigation system located onboard the vessel. The riser column is then lowered from vessel 10 and moved toward the subsea installation. As is customary, this is done by progressively lowering the riser into the water by coupling together pipe sections to lengthen the riser. To maneuver the riser into position wherein the probe arms are engaged by the guide funnels, the vessel, as is known in the art, may be moved about the subsea installation by means of thrusters on the vessel.

Guidance means are also mounted on lower machine package 150 for locating the subsea installation. The guidance means may comprise a TV camera 144 and a sonar transducer 145. This equipment is in communication with TV and sonar sending and receiving equipment located on vessel 10. The equipment may be any commercially-available type. Sonar reflectors, which are not illustrated, will also normally be mounted on the subsea installation.

As riser 50 is lowered through the water, the TV and sonar equipment is used to guide the riser into a position above and proximate to the subsea installation. Telescopic posts 80 and 80*a* will be operated to be in their extended position. That is to say, the arms of both posts will be in the position illustrated in FIG. 4 wherein the arms extend a substantial distance below package 150. The riser will then be maneuvered as necessary to align the probe arms of posts 80 and 80*a* with guide funnels 90 and 90*a*, respectively. The riser will then be lowered so that the arms of the telescopic posts engage the guide funnels with tapered ends 86 of the arms sliding along one or other of the inclined surfaces 91 and into neck portion 92 of the guide funnels, see FIG. 5. With the arms of the posts extending through the neck portions of the funnels as illustrated in FIG. 5, the riser is properly positioned on and orientated relative to the subsea installation. It may then be disconnectably connected into operative association with the subsea installation by means of riser connector 56.

After the riser has been connected onto the subsea installation, telescopic posts 80 and 80*a* will be moved into their retracted position, see FIG. 2. That is, the piston-cylinder assemblies of the respective posts are operated to bring arms 84 within housing 82 as illustrated in FIG. 6. With the arms in their retracted position, the possibility that the riser will hang up in the subsea installation in quick release situations is practically eliminated. Therefore, to remove the riser from the subsea installation in a high angle release situation that occurs in vessel "drift-off" or "drive-off", all that would be necessary would be to operate connector 56 to disconnect the riser from the subsea installation.

When it is desirable to reposition and reattach the riser to the subsea installation, the above-discussed procedure for riser entry would be carried out. This procedure permits a rapid entry of the riser into the subsea installation.

It is noted from the above description of the invention that the probe assembly, which includes telescopic guideposts 80 and 80*a*, is removably mounted to the lower marine riser package, and that the receiver assembly, which includes guide funnels 90 and 90*a*, is removably mounted on the subsea installation guide frame. Thus, by removing the probe and receiver assemblies, and connecting guideposts and associated guidelines to the permanent guide base, the guidelineless system of the invention may be converted to a guideline system. In this manner, the guidelineless riser entry/reentry system of the invention retains the features of a guideline system.

It is further noted that the telescopic post may have a staggered arrangement wherein, in the extended position, one post extends farther below the riser column than does the other. This arrangement simplifies positioning of the riser on the subsea installation as only one post needs to be initially located in a guide funnel.

Although a specific embodiment of the invention has been described in detail, the invention is not to be limited to only such an embodiment but rather only by the scope of the appended claims.

What is claimed is:

1. A guidelineless system for use in positioning a riser column on a subsea installation at a well site, the system permitting quick attachment or release of the riser column from the subsea installation, comprising:

a first telescopic guidepost affixed at the lower end of the riser column and movable between an extended position and a retracted position;

a second telescopic guidepost affixed at the lower end of the riser column on a side opposite to said first guidepost, said second guidepost movable between an extended position and a retracted position;

a first means affixed at the upper end of the subsea installation for receiving said first guidepost;

a second means affixed at the upper end of the subsea installation on a side opposite to said first means for receiving said second guidepost;

means for locating the subsea installation;

means for moving the riser column toward the subsea installation wherein said first guidepost is in its extended position to engage said first means and said second guidepost is in its extended position to engage said second means to position the riser column on the subsea installation; and means for disconnectably connecting the riser column to the subsea installation after said first and said second guideposts have been positioned in said first and said second means, said first and said second guideposts when in their retracted position not contacting said first and said second means.

2. The guidelineless system of claim 1 wherein said first and second guideposts are hydraulically actuated.

3. The guidelineless system of claim 2 wherein said first guidepost is affixed to the riser column on a side thereof diametrically opposite to said second post.

4. The guidelineless system of claim 1 wherein said first and second means affixed to the upper end of the subsea installation are guide funnels, the larger openings of which are positioned upwardly in relation to the subsea installation with a neck portion extending axially downwardly from each of said larger openings.

5. The guidelineless system of claim 4 wherein the riser column is in position to be connected to the subsea installation when the lower ends of said first and said second guideposts are respectively located in the neck portion of said first and second guide funnels.

6. A guidelineless system for use in positioning a riser column on a subsea installation at a well site, the system permitting quick attachment to or release of the riser column from the subsea installation, comprising:

two telescopic guideposts affixed to the lower end of the riser column one each on opposite sides thereof and in substantially parallel relationship therewith, said guideposts movable between a retracted position and an extended position;

two guide funnels mounted on the upper end of the subsea installation one each on opposite sides thereof, the larger opening of said funnels positioned upwardly in relation to the subsea installation and the neck portion of said funnels extending axially downwardly therefrom for engaging the lower end of said guideposts;

means for locating the subsea installation;

means for moving the riser column toward the subsea installation wherein each of said guideposts are in their extended position so that the lower ends thereof engage a respective one of said funnels to operatively position riser column at the subsea installation; and means for disconnectably connecting the riser column to the subsea installation when the riser column is positioned and orientated with respect thereto, said guideposts when in their retracted position not contacting the guide funnels.

7. The guidelineless system of claim 6 wherein the subsea installation includes a guide frame that may be used with a guideline system for guiding equipment to the subsea installation.

8. The guidelineless system of claim 7 wherein said guide funnels are removably mounted to said guide frame to be located on opposite sides of the subsea installation.

9. A guidelineless system for use in positioning a riser column at a subsea installation at a subsea well site and for permitting quick release of the riser column from the subsea installation, comprising:

two probes affixed at the lower end of the riser column one each on opposite sides thereof and in substantially parallel relationship therewith, each of said probes including a housing affixed at the lower end of the riser column, an arm arranged in said housing to be slidably movable therein, the lower portion of said arm having a generally downwardly-tapered shape, and means in said housing to move said arm between an extended position and a retracted position;

two guide funnels connected at the upper end of the subsea installation one each on opposite sides thereof, each of said funnels having their larger openings positioned upwardly in relation to the subsea installation for receiving the lower portion of said arms of said probes to position and orientate the riser column at the subsea installation;

means for locating the subsea installation;

means for moving the riser column toward the subsea installation to locate each of said arms of said probes in a respective one of said funnels, said arms of said probes in their extended position; and means for disconnectably connecting the riser column to the subsea installation when the riser column is operatively positioned thereon, said arms of said probes in their retracted position.

10. A guidelineless system for use in positioning a riser column at a subsea installation at a well site, the system permitting quick attachment or release of the riser column from the subsea installation, comprising:

at least two probes affixed to the lower end of the riser column one each on opposite sides thereof, said probes including a substantially cylindrical-shaped housing affixed to the lower end of the riser, a substantially cylindrical-shaped arm concentrically arranged and slidably movable within said housing, the lower portion of said arm having a generally tapered configuration, and means for moving said arm between a retracted position where the major part of said arm along its longitudinal axis is located within said housing and an extended position where the lower portion of said arm is located substantially below the lower end of the riser column;

at least two funnel guide means affixed to the upper end of the subsea installation one each on opposite sides thereof for receiving said arms of probes when said arms are in their extended position to position and orientate the riser with respect to the subsea installation for connection thereto, each of said funnel guide means including a wide mouth portion positioned upwardly in relation to the subsea installation and a neck portion extending axially downwardly from said mouth portion;

means for locating the subsea installation;

means for moving the riser column toward the subsea installation to locate a respective one of said arms of said probes in the wide mouth portion of a respective funnel means to orientate the riser at the subsea installation, said arms of said probes being in their extended position; and means for disconnectably connecting the riser column to the subsea installation after said arms of said probes have been positioned in the neck portion of said funnel means, said riser column being operatively connected to the subsea installation and said arms of said probes being in their retracted position.

11. The guidelineless system of claim 10 wherein said probes further include means for locking said arms in their retracted position.

12. A guidelineless system for making a remote connection between a subsea installation and a riser column extending from a floating vessel on the surface of a body of water, the system allowing quick release of the riser column from the subsea installation, comprising:

a probe assembly connected to the lower end of the riser column, said probe assembly including a first housing affixed to the lower end of the riser column in substantially parallel relation therewith, a second housing affixed to the lower end of the riser column on a side thereof opposite from the side where said first housing is affixed, an arm arranged in each of said housings to be movable therein along an axis substantially parallel to that of the riser column, the lower portions of said arms having a generally downwardly-tapered shape, and means in each of said housings for moving said arms between a retracted position where said arms are substantially located within said housings and an extended position where the lower portions of said arms extend substantially beyond the lower end of the riser column;

means for locating the subsea installation;

means for moving the riser column toward the subsea installation;

a receiver assembly affixed to the upper end of the subsea installation for receiving said probe assembly to position the riser on the subsea installation for connection thereto, said receiver assembly including two funnel guide means one each affixed on opposite sides of the subsea installation for engaging said arms of said probe assembly when said arms are in their extended position so that the riser column may be operatively positioned on the subsea installation; and means for disconnectably connecting the riser column to the subsea installation so that the riser column may thereafter be removed, said arms of said probe assembly in their retracted position when the riser column is connected to the subsea installation.

13. The guidelineless system of claim 12 wherein said receiver assembly is removably mounted on a guide frame that is part of the subsea installation, said guide frame being capable of use with a guideline system for guding equipment to the subsea installation.

14. The guidelineless system of claim 13 wherein the probe assembly is removably mounted on the riser column.

15. The guidelineless system of claim 12 wherein the probe assembly further includes means for locking said arms of said probe assembly in their retracted position.

16. A method for positioning a riser column at a subsea installation at a well site, comprising:

affixing at least two telescopic guideposts to the lower end of the riser column one each on opposite sides thereof, said guideposts movable between a retracted and an extended position;

mounting at least two guide funnel means at the upper end of the subsea installation one each on opposite sides thereof for receiving said guideposts;

locating the subsea installation;

moving the riser column toward the subsea installation;

positioning the riser column on the subsea installation by maneuvering the riser column so that said guideposts in their extended position are engaged by said guide funnel means;

disconnectably connecting the riser column to the subsea installation; and moving said guideposts into their retracted position after the riser column is operatively connected to the subsea installation so as to permit quick release of the riser column from the subsea installation.

17. The method of claim 16 wherein the riser column is removed from the subsea installation by disconnecting the riser column from the subsea installation with said guideposts in their retracted position.

18. A method for positioning a riser column at a subsea installation where the riser column extends from a floating platform on the surface of a body of water, comprising:

affixing two housings to the lower end of the riser column, one each on opposite sides of the riser column and in substantially parallel relationship therewith;

arranging an arm in each of said housings to be slidably movable therein in parallel relationship with the riser column wherein said arm is movable between an extended position where the lower part of said arm extends substantially below the lower end of the riser column and a retracted position where said arm is located substantially within said housing;

mounting a first guide funnel to the upper end of the subsea installation with the larger opening of said first funnel positioned upwardly in relation to the subsea installation with the neck portion extending axially downwardly therefrom;

mounting a second guide funnel to the upper end of the subsea installation on a side thereof diametrically opposite from said first funnel, the larger opening of said second funnel positioned upwardly in relation to the subsea installation with the neck portion extending axially downwardly therefrom;

locating the subsea installation;

moving the riser column toward the subsea installation;

moving said arms into their extended position;

maneuvering the riser column so as to locate said one of said arms in each of the larger openings of said funnels so that the riser column is appropriately orientated on the subsea installation;

lowering said riser column onto the subsea installation for connection thereto wherein the lower part of said arms are extended into the neck portion of said funnels;

disconnectably connecting the riser column into operative association with the subsea installation; and moving said arms into their retracted position to permit quick release of the riser column from the subsea installation.

19. The method of claim 18 where the riser column is removed from the subsea installation by disconnecting the riser column from the subsea installation with said arms in their retracted position.

20. The method of claim 18 further comprising the step of locking said arms into their retracted position.

* * * * *